US008031152B2

(12) United States Patent
Yamamoto et al.

(10) Patent No.: US 8,031,152 B2
(45) Date of Patent: Oct. 4, 2011

(54) DISPLAY DEVICE

(75) Inventors: Keiichi Yamamoto, Kanagawa (JP); Hiroshi Hayama, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 751 days.

(21) Appl. No.: 12/213,663

(22) Filed: Jun. 23, 2008

(65) Prior Publication Data

US 2008/0266505 A1 Oct. 30, 2008

(30) Foreign Application Priority Data

Jul. 3, 2007 (JP) ..... 2007-174966

(51) Int. Cl.
*G09G 3/36* (2006.01)

(52) U.S. Cl. ..... 345/93; 345/98; 345/103
(58) Field of Classification Search ..... 345/87–104
See application file for complete search history.

(56) References Cited

U.S. PATENT DOCUMENTS

| | | | | |
|---|---|---|---|---|
| 6,587,089 | B1 | 7/2003 | Nakajima | |
| 7,283,115 | B2 * | 10/2007 | Morii | 345/100 |
| 2007/0024560 | A1 * | 2/2007 | Kim et al. | 345/94 |
| 2007/0085798 | A1 * | 4/2007 | Hashimoto et al. | 345/93 |

FOREIGN PATENT DOCUMENTS

JP 2000-250068 9/2000

* cited by examiner

*Primary Examiner* — Jimmy H Nguyen
(74) *Attorney, Agent, or Firm* — McGinn IP Law Group, PLLC

(57) ABSTRACT

A display device includes: a display unit; scanning lines connected to rows of the pixels; data lines connected to columns of the pixels; a dummy scanning line being extended in parallel with the scanning lines; a scanning driver which outputs a selection signal to a selected scanning line and to the dummy scanning line in response to a selection clock signal; a data driver which outputs data for displaying one scanning line in response to a timing determination signal; and a timing determination signal line connected to a node preset on the dummy scanning line and transmits the selection signal transmitted to the node to the data driver as the timing determination signal. Even for a large size display, displaying defects can be prevented.

6 Claims, 6 Drawing Sheets

DISPLAY DEVICE

INCORPORATION BY REFERENCE

This Patent Application is based on Japanese Patent Application No. 2007-174966. The disclosure of the Japanese Patent Application is incorporated herein by reference.

BACKGROUND OF THE INVENTION

1. Field of the Invention

The present invention relates to a display device for displaying a screen.

2. Description of Related Art

Various types of display devices such as the TFT (Thin Film Transistor) liquid crystal display device, the simple matrix liquid crystal display device, the electro luminance (EL) display device and the plasma display device are widely spread. On a display device, a screen is displayed. In recent years, the display size tends to become larger in order to display large size images.

However, as the size of a display device becomes larger, the signal delay caused by resistances or capacitances of scanning lines of the display device becomes larger. This delay causes a lag of the timing of outputting data on screen, which may cause a defect in the display screen. Therefore, it is desired to prevent such a defect.

As an example of the technique for preventing this problem, Japanese Laid-Open Patent Application JP-P2000-250068A (referred to as Patent Document 1) describes a TFT liquid crystal display device 100. As shown in FIG. 1, this TFT liquid crystal display device 100 includes: a glass substrate 101, a scanning driver (gate driver) 108, a drain driver 107, and a display unit (liquid crystal panel).

The liquid crystal panel includes a plurality of pixels arranged on a glass substrate 101 in a matrix form.

Each of the plurality of pixels includes: a thin film transistor (TFT) 102, and a pixel capacitor 105. The pixel capacitor 105 includes a pixel electrode and an opposite electrode opposing the pixel electrode. The opposite electrode is grounded. The TFT 102 includes: a drain electrode 103, a source electrode 104 connected to the pixel electrode, and a gate electrode 106.

The TFT liquid crystal display device 100 further includes: a k-number of scanning lines (gate lines) 108G1 to 108Gk (where k is an integer of two or larger).

To the gate electrodes 106 of the TFTs 102 of the pixels in a plurality of rows, the k-number of gate lines 108G1 to 108Gk are respectively connected.

To the gate driver 108, the k-number of gate lines 108G1 to 108Gk described above are connected.

The TFT liquid crystal display device 100 further includes a j-number of data lines 107D1 to 107Dj (where j is an integer of two or larger).

To the drain electrodes 103 of the TFTs 102 of the pixels in a plurality of columns, the j-number of data lines 107D1 to 107Dj are respectively connected.

To the drain driver 107, the j-number of data lines 107D1 to 107Dj described above are connected.

The TFT liquid crystal display device 100 further includes a dummy gate line 109.

The drain driver 107 includes a latch terminal 112.

The dummy gate line 109 is provided on the glass substrate 101 in parallel to the k-number of gate lines 108G1 to 108Gk. To the gate driver 108, one end (input end) 109*a* of the dummy gate line 109 is connected as a 0-th gate line. The other end (terminal end) 109*b* of the dummy gate line 109 is connected to the latch terminal 112.

To the gate driver 108, selection clock signals (VCK, VSP) are supplied. These selection clock signals (VCK, VSP) are defined as clock signals for selecting the gate line 108G1 in one horizontal period.

The gate driver 108, in response to the selection clock signals (VCK, VSP), outputs a selection signal to the gate line 108G1. At this point, to the gate line 108G1, the selection signal is transmitted in order from one end to the other end thereof, and the TFTs 102 of a j-number of pixels corresponding to the gate line 108G1 are turned on by the selection signal supplied to the gate electrodes 106.

Moreover, to the dummy gate line 109, the clock signal VCK is supplied. At this point, to the dummy gate line 109, the clock signal VCK is transmitted in order from the input end 109*a* to the terminal end 109*b* thereof. As a result, the clock signal VCK transmitted to the terminal end 109*b* of the dummy gate line 109 is transmitted as a latch signal LP to the latch terminal 112 of the drain driver 107.

To the drain driver 107, a clock signal HCK and a j-number of one-line display data DAT are supplied.

The drain driver 107, in accordance with the clock signal HCK and the latch signal LP, outputs the j-number of one-line display data DAT to the j-number of data lines 107D1 to 107Dj. At this point, the TFTs 102 of the j-number of pixels corresponding to the gate line 108G1 and the j-number of data lines 107D1 to 107Dj are on. Thus, in the pixel capacitors 105 of the pixels corresponding to the j-number of data lines 107D1 to 107Dj, the j-number of one-line display data DAT are respectively written and held until the next writing. Consequently, the j-number of one-line display data DAT are displayed.

With the TFT liquid crystal display device 100 explained above, when the gate driver 108 has outputted the selection signal to the gate line 108G1, this selection signal is delayed by resistance and capacitance of the gate line 108G1. In this case, when the gate driver 108 has outputted a selection signal to the dummy gate line 109, this selection signal is delayed by resistance and capacitance of the dummy gate line 109. The delay time from when the gate driver 108 has outputted the selection signal to the dummy gate line 109 to when the selection signal is transmitted to the terminal end of the dummy gate line 109 is represented by $\Delta t$.

The delay time $\Delta t$ shows the timing (transmission timing) at which the selection signal inputted from the input end transmits to the terminal end of the dummy gate line 109.

The clock signal VCK transmitted to the terminal end 109*b* of the dummy gate line 109 is transmitted as the latch signal LP to the latch terminal 112 of the drain driver 107 while being delayed by the delay time $\Delta t$. The drain driver 107, in accordance with the clock signal HCK and the latch signal LP, outputs the j-number of one-line display data DAT to the j-number of data lines 107D1 to 107Dj. Therefore, the delay time $\Delta t$ determines the timing (output timing) of outputting data by the drain driver 107.

Consequently, in the TFT liquid crystal display device 1 explained above, the timing of outputting data by the drain driver 107 can be adjusted to the delay by the resistance and capacitance of the gate line 108G1. As a result, a displaying defect caused by the signal delay can be prevented in the TFT liquid crystal display device 1.

SUMMARY

However, in the TFT liquid crystal display device 100 explained above, the transmission timing is defined at the terminal end 109*b* of the dummy gate line 109, and thus the position cannot be determined flexibly for adjusting the transmission timing and the output timing.

Typically, to display data on a screen larger than conventional screens, a plurality of gate drivers 108 and a plurality of drain drivers 107 are used to provide a large-size liquid crystal panel. In this case, in the TFT liquid crystal display device 100 explained above, since the aforementioned position cannot be determined flexibly for adjusting the transmission timing and the output timing, it is difficult to prevent the displaying defect when the size of the liquid crystal panel becomes larger.

In an aspect of the present invention, a display device includes: a display unit including a plurality of pixels arranged to form a matrix; a plurality of scanning lines respectively connected to a plurality of rows of the matrix of the plurality of pixels; a plurality of data lines respectively connected to a plurality of columns of the matrix of the plurality of pixels; a dummy scanning line configured to be extended in parallel with the plurality of scanning lines; a scanning driver configured to output a selection signal to a selected scanning line of the plurality of scanning lines and the dummy scanning line in response to a selection clock signal; a data driver configured to output a display data for displaying data on one scanning line in response to a timing determination signal; and a timing determination signal line connected to a node preset on the dummy scanning line and configured to transmit the selection signal transmitted to the node to the data driver as the timing determination signal.

With a display device of the present invention, displaying defect can be prevented for large size of displays.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF THE PREFERRED EMBODIMENTS

Herein, a display device according to embodiments of the present invention will be described with reference to attached drawings.

A display device of the present invention is applied to a TFT (Thin Film Transistor) liquid crystal display device, a simple matrix liquid crystal display device, an electro luminance (EL) display device, a plasma display device, etc. For example, assuming that the display device of the present invention is a TFT liquid crystal display device, a description will be given below, referring to the accompanying drawings.

Figure 1:
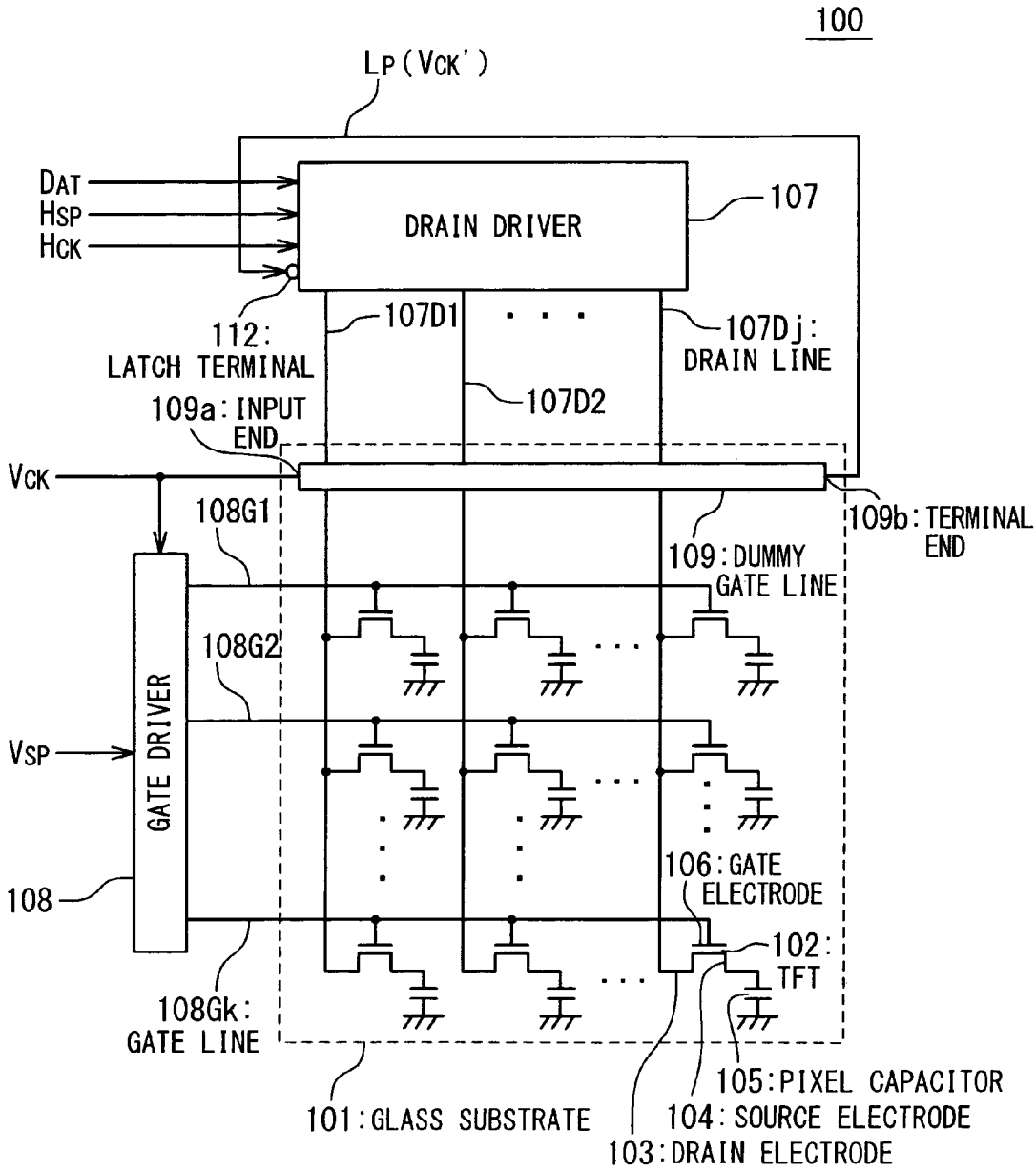
FIG. 1 shows a configuration of a reference example of the TFT liquid crystal display.
Figure 2:
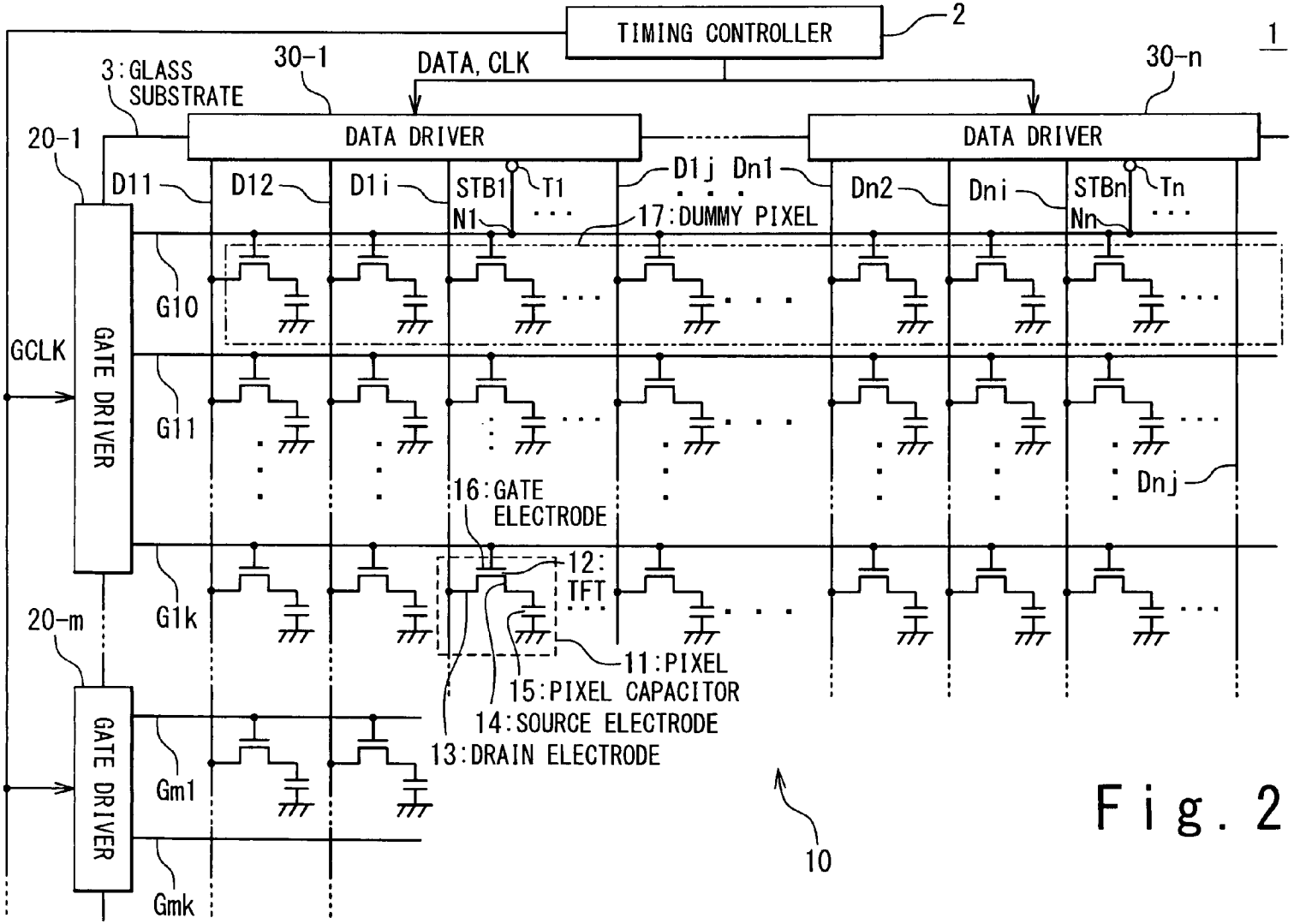
FIG. 2 shows a configuration of a TFT liquid crystal display device 1 as a display device of the present invention (first embodiment)

FIG. 2 shows a configuration of a TFT liquid crystal display device 1 according to an embodiment of the present invention.

The TFT liquid crystal display device 1 includes: a glass substrate 3, an m-number of scanning drivers (gate drivers) 20-1 to 20-*m*; an n-number of data drivers 30-1 to 30-*n* (where m and n are each an integer of 1 or larger).

The m-number of gate drivers 20-1 to 20-*m* are arranged on the glass substrate 3 in this order from row 1 to row m.

The n-number of data drivers 30-1 to 30-*n* are arranged on the glass substrate 3 in this order from column 1 to column n.

The TFT liquid crystal display device 1 further includes a display unit (liquid crystal panel) 10.

The liquid crystal panel 10 includes a plurality of pixels 11 arranged on the glass substrate 3 in a matrix form. For example, as the plurality of pixels 11, a {(m×k)×(n×j)}-number of pixels 11 are arranged on the glass substrate 3 (where k and j are each an integer of 2 or larger).

Each of the {(m×k)×(n×j)}-number of pixels 11 includes: a thin film transistor (TFT) 12 and a pixel capacitor 15. The pixel capacitor 15 includes a pixel electrode and an opposite electrode opposing the pixel electrode. The opposite electrode is grounded. The TFT 12 includes a drain electrode 13, a source electrode 14 connected to the pixel electrode, and a gate electrode 16.

The TFT-type liquid crystal display device 1 further includes an (m×k)-number of scanning lines (gate lines) G11 to G1*k*, . . . , Gm1 to Gmk.

To the gate electrodes 16 of the TFTs 12 of the pixels 11 in an (m×k)-number of rows, the (m×k number of gate lines G11 to G1*k*, . . . , Gm1 to Gmk are respectively connected.

To the m-number of gate drivers 20-1 to 20-*m*, a k-number of (first to k-th) gate lines are respectively connected. That is, to the m-number of gate drivers 20-1, . . . , 20-*m*, one ends of the aforementioned (m×k)-number of gate lines G11 to G1*k*, . . . , Gm1 to Gmk are respectively connected.

The TFT liquid crystal display device 1 further includes an (n×j)-number of data lines D11 to D1*j*, . . . , Dn1 to Dnj.

To the drain electrodes 13 of the TFTs 12 of the pixels 11 in an (n×j)-number of columns, the (n×j)-number of data lines D11 to D1*j*, . . . , Dn1 to Dnj are respectively connected.

To the n-number of data drivers 30-1 to 30-*n*, a j-number of (first to j-th) data lines are respectively connected. That is, to the n-number of data drivers 30-1, . . . , 30-*n*, one ends of the aforementioned (n×j)-number of data lines D11 to D1*j*, . . . , Dn1 to Dnj are respectively connected.

The liquid crystal panel 10 further includes dummy pixels 17 arranged on the glass substrate 3 for one display line (arranged in a row). For example, as the dummy pixels 17 for one display line, a {1×(n×j)}-number of dummy pixels 17 are arranged on the glass substrate 3.

Each of the {1×(n×j)}-number of dummy pixels 17 has a same configuration as that of the pixels 11 described above.

The TFT liquid crystal display device 1 further includes a dummy scanning line (dummy gate line) G10.

To gate electrodes 16 of TFTs 12 of the dummy pixels 17 in one row, the dummy gate line G10 is connected. That is, the dummy gate line G10 is formed on the glass substrate 3 in parallel to the (m×k)-number of gate lines G11 to G1*k*, . . . , Gm1 to Gmk.

To drain electrodes 13 of TFTs 12 of the dummy pixels 17 in an (n×j)-number of columns, the (n×j)-number of data lines D11 to D1*j*, . . . , Dn1 to Dnj are respectively connected.

To one of the m-number of gate drivers 20-1 to 20-*m* (for example, to the gate driver 20-1), one end of the dummy gate line G10 is further connected as a 0-th gate line. That is, to the gate driver 20-1, a (k+1)-number of gate lines are connected.

The liquid crystal display device 1 further includes an n-number of timing determination signal lines STB1 to STBn.

The n-number of data drivers 30-1 to 30-*n* respectively include an n-number of terminals T1 to Tn. One ends of the n-number of timing determination signal lines STB1 to STBn are respectively connected to the n-number of terminals T1 to Tn.

The other ends of the n-number of timing determination signal lines STB1 to STBn are respectively connected to the n-number of nodes N1 to Nn.

The n-number of nodes N1, . . . , Nn are respectively provided at predetermined positions of an (n×j)-number of positions on the dummy gate line G10 so that the timing (transmission timing) at which selection signals to be described below are transmitted to an (n×j)-number positions corresponding to the (n×j)-number of data lines D11 to D1*j*, . . . , Dn1 to Dnj of the dummy gate line G10 and timing (output timing) of outputting by the n-number of data drivers 30-1, . . . , 30-*n* are adjusted. For example, the n-number of nodes N1, . . . , Nn are provided at positions corresponding to the i-th data line D1*i*, . . . , Dn*i* (where i is an integer that satisfies $1 \leqq i \leqq j$) of the dummy gate line G10.

The TFT liquid crystal display device 1 further includes a timing controller 2.

The timing controller 2 supplies first to (m×k)-th gate clock signals GCLK in this order to the m-number of gate drivers 20-1 to 20-*m*. For example, assume that the timing controller 2 has supplied the selected gate clock signals GCLK to the m-number of gate drivers 20-1 to 20-*m*. The selected gate clock signals GCLK are gate clock signals GCLK for selecting the gate line G11 in one horizontal period.

The gate driver 20-1 of the m-number of gate drivers 20-1 to 20-*m*, in response to the selected gate clock signal GCLK, outputs a selection signal to the gate line G11. At this point, to the gate line G11, the selection signal is transmitted from one end to the other end thereof in this order, so that the TFTs 12 of a {1×(n×j)}-number of pixels 11 corresponding to the gate line G11 are turned on by the selection signal supplied to the gate electrodes 16.

Moreover, the gate driver 20-1, in response to the selected gate clock signal GCLK, outputs the selection signal to the gate line G11 and also outputs the selection signal to the dummy gate line G10. At this point, to the dummy gate line G10, the selection signal is transmitted from one end to the other end thereof in this order. As a result, selection signals transmitted from the dummy gate line G10 to the n-number of timing determination signal lines STB1 to STBn via the n-number of nodes N1 to Nn are respectively transmitted as an n-number of timing determination signals to the n-number of terminals T1 to Tn of the n-number of data drivers 30-1 to 30-*n*.

Note that the gate driver 20-1 outputs a selection signal to the dummy gate line G10 every one cycle of the selected gate clock signal GCLK.

The timing controller 2 supplies an n-number of clock signals CLK and an n-number of display data DATA for one line to the n-number of data drivers 30-1 to 30-*n*, respectively. The n-number of display data DATA respectively include a j-number of one-line display data corresponding to the data lines D11 to D1*j*, . . . , Dn1 to Dnj.

The n-number data drivers 30-1 to 30-*n*, in accordance with the n-number of clock signals CLK and the n-number of timing determination signals, output the n-number of display data DATA for one line to the j-number of data lines D11 to D1*j*, . . . , Dn1 to Dnj connected to the n-number of data drivers 30-1 to 30-*n*. That is, an (n×j)-number of one-line display data are respectively outputted to the (n×j)-number of data lines D11 to D1*j*, . . . , Dn1 to Dnj. At this point, the TFTs 12 of a {1×(n×j)}-number of pixels 11 corresponding to the gate line G11 and the (n×j)-number of data lines D11 to D1*j*, . . . , Dn1 to Dnj are on. Thus, to the pixel capacitors 15 of the pixels 11 corresponding to the (n×j)-number of data lines D11 to D1*j*, . . . , Dn1 to Dnj, the (n×j)-number of one-line display data are respectively written and held for the next writing. Consequently, the (n×j)-number of one-line display data are displayed.

In the TFT liquid crystal display device 1 of the present embodiment, when the gate driver 20-1 has outputted a selection signal to the gate line G11, this selection signal is delayed by the resistance and capacitance of the gate line G11. Also, when the gate driver 20-1 has outputted a selection signal to the dummy gate line G10, this selection signal is delayed by the resistance and capacitance of the dummy gate line G10. The delay times from when the gate driver 20-1 has outputted the selection signal to the dummy gate line G10 to when the selection signals are transmitted to the nodes N1 to Nn of the dummy gate line G10 are represented by Δt1 to Δtn, respectively. The delay times Δt1 to Δtn become longer in this order.

The delay time Δt1 represents timing (transmission timing) at which selection signals are transmitted to a j-number of positions corresponding to the j-number of data lines D11 to D1*j* of the dummy gate line G10. The delay time Δtn represents timing (transmission timing) at which the selection signals are transmitted to a j-number of positions corresponding to the j-number of data lines Dn1 to Dnj of the dummy gate line G10.

The selection signals transmitted from the dummy gate line G10 to the timing determination signal lines STB1 to STBn via the nodes N1 to Nn are respectively transmitted as the first to n-th timing determination signals to the terminals T1 to Tn of the n-number of data drivers 30-1 to 30-*n* while being delayed by the delay times Δt1 to Δtn respectively. The n-number of data drivers 30-1 to 30-*n*, in accordance with the first to n-th clock signals CLK and the first to n-th timing determination signals, respectively output the first to n-th display data DATA for one line (j-number of one-line display data) to the data lines D11 to D1*j*, . . . , Dn1 to Dnj. Therefore, the delay times Δt1 to Δtn determine timing (output timing) of outputting by the n-number of data drivers 30-1 to 30-*n*.

As described above, in the TFT liquid crystal display device 1 of the present embodiment, by previously providing in the dummy gate line G10 the nodes N1 to Nn (timing determination signal lines STB1 to STBn) as desired positions for adjusting transmission timing and outputting timing described above for the respective n-number of data drivers 30-1 to 30-*n*, outputting timing can be adjusted to an optimum delays for the data drivers 30-1 to 30-*n* for the respective nodes N1 to Nn. As a result, in the TFT liquid crystal display device 1 of the present embodiment, displaying defects can be prevented.

Moreover, with the TFT liquid crystal display device 1 of a present embodiment, to display data on a large size screen, a plurality of gate drivers 20-1 to **20-*m* and a plurality of data drivers 30-1 to 30-*n* are used to provide a large-size liquid crystal panel 10**.

Namely, compared with the case in which only one scanning driver (gate driver) and only one data driver are equipped with, m−1 number of other scanning drivers (m is an integer more than 1) 20-2 to **20-*m*** and *n*−1 number of other data drivers 30-2 to **30-*n* are further provided. In this case, the n−1 number of other timing determination signal lines STB2 to STBn are further provided. The k number of scanning lines are connected to each of the m−1 number of other scanning drivers. The j number of data lines are connected to each of the n-number of other data drivers. The n−1 number of nodes N2 to Nn are further preset on the dummy scanning line. The n−1 number of other timing determination signal lines are respectively connected to the n−1 number of nodes. The n−1 number of other data drivers are respectively connected to the n−1 number of the other timing determination signal lines. In response to the selection clock signal, the scanning driver outputs other selection signal to the dummy scanning line, and a selected scanning driver of the m−1 number of other scanning drivers outputs the other selection signal to a selected scanning line of the k number of scanning lines connected to the selected scanning driver. The other selection signal transmitted to n number of timing determination signal lines consisting of the timing determination signal line STB1 and the n−1 number of other timing determination signal lines STB 2 to STBn via n number of nodes consisting of the node N1 and the n−1 number of nodes N2 to Nn are respectively transmitted to n number of data drivers consisting of the data driver 30-1 and the n−1 number of other drivers 30-2 to 30-*n*** as n number of timing determination signals. The n number of data drivers respectively output a display data to j number of data lines connected to each of the n number of data drivers in response to the n number of timing determination signals to output data for displaying one scanning line.

Thus, the n-number of nodes N1, . . . , Nn described above are respectively provided at predetermined positions of the (n×j)-number of positions on the dummy gate line G10 so that the timing at which the selection signals are transmitted to the (n×j)-number of positions corresponding to the (n×j)-number of data lines D11 to D**1*j*, . . . , Dn1 to Dnj of the dummy gate line G10 and the timing of outputting by the n-number of data drivers 30-1 to 30-*n* are adjusted. For example, the n-number of nodes N1, . . . , Nn are respectively provided at positions corresponding to the i-th data lines D1*i*, . . . , Dni (where i is an integer that satisfies 1≦i≦j) of the dummy gate line G10**.

Consequently, in the TFT liquid crystal display device 1 of the present embodiment, the aforementioned transmission timing is not defined at the terminal end of the dummy gate line G10, and thus desired positions can be selected flexibly for adjusting the transmission timing and the output timing described above. Thus, the displaying defect can be prevented even when the size of the liquid crystal panel 10 becomes large.

With the TFT liquid crystal display device 1 of the present embodiment, an optimum transmission timing and output timing can be automatically selected for each of the n-number of data drivers 30-1 to **30-*n*, further upsizing of the liquid crystal panel 10** can be achieved.

Figure 3:
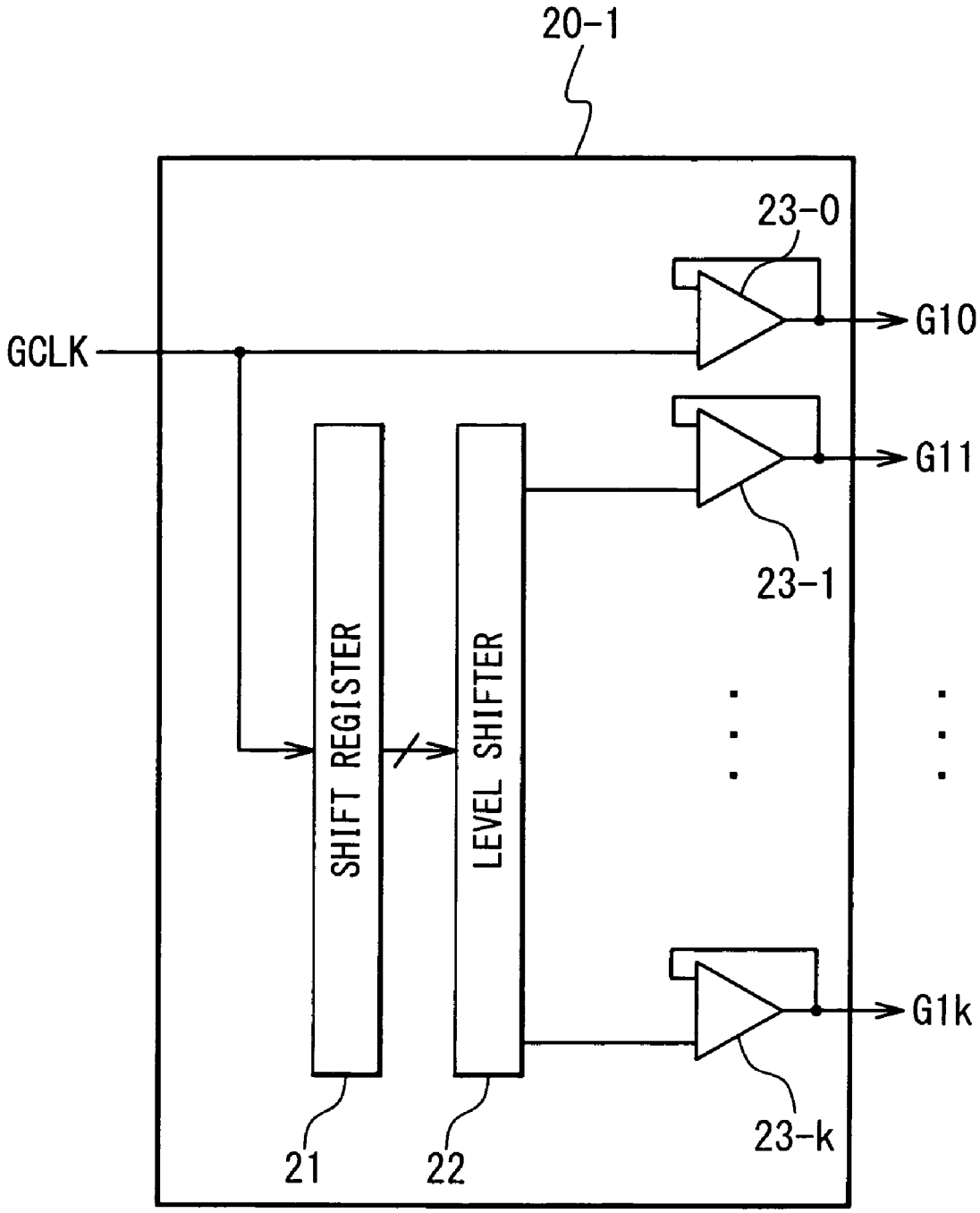
FIG. 3 shows a configuration of one of the m-number of gate drivers 20-1 to 20-*m* (exemplified by the gate driver 20-*m*) of the TFT liquid crystal display device 1 of the present invention (first and second embodiments)

FIG. 3 shows a configuration of one of the m-number of gate drivers 20-1 to **20-*m* (for example, the gate driver 20-1**).

Each of the m-number of gate drivers 20-1 to **20-*m* has a shift register 21, a level shifter 22, and a gate output circuit. The gate output circuit includes a k-number of output buffers 23-1 to 23-*k***.

The shift register 21 is connected to the level shifter 22, which is connected to the gate output circuit. The k-number of output buffers 23-1 to **23-*k* of the gate output circuit of the gate driver 20-1 are connected to one ends of the gate lines G11 to G1*k*, and a k-number of output buffers 23-1 to 23-*k* of the gate output circuit of the gate driver 20-*m* are connected to one ends of the gate lines Gm1** to Gmk.

For example, the timing controller 2 supplies a selected gate clock signal GCLK and gate shift pulse signals (not shown) to the gate driver 20-1 of the m-number of gate drivers 20-1 to **20-*m*, and the gate driver 20-1 selects the gate line G11** in accordance with the selected gate clock signal GCLK and the gate shift pulse signals.

In this case, the shift register 21 of the gate driver 20-1 sequentially shifts the gate shift pulse signals in synchronization with the gate clock signal GCLK and outputs them to the level shifter 22. The level shifter 22 of the gate driver 20-1 performs level conversion on the gate shift pulse signals, and outputs them to the gate output circuit. Here, the gate shift pulse signal outputted to the output buffer 23-1 of the gate output circuit corresponds to the aforementioned selected gate clock signal GCLK, and the output buffer 23-1 outputs the gate shift pulse signal as a selection signal to the gate line G11. In this case, a signal level of the selection signal outputted from the output buffer 23-1 of the gate driver 20-1 is in an active state, while each of the signal levels of other selection signals are in an inactive state. At this point, to the gate line G11, the selection signal is transmitted to one end to the other end thereof in this order.

The gate driver 20-1 further includes a dummy gate line output buffer 23-0. The dummy gate line output buffer 23-0 is connected to the dummy gate line G10 described above, and is supplied with the gate clock signal GCLK from the timing controller 2.

Of the m-number of gate drivers 20-1 to **20-*m*, the gate driver 20-1 selects the gate line G11 and also the dummy gate line G10** in accordance with the selected gate clock signal GCLK.

In this case, the dummy gate line output buffer 23-0 of the gate driver 20-1 outputs the gate clock signal GCLK as a selection signal to the dummy gate line G10. Here, a signal level of the selection signal outputted from the dummy gate line output buffer 23-0 is in an active state. At this point, to the dummy gate line G10, the selection signal is transmitted from one end to the other end thereof in this order.

Figure 4:
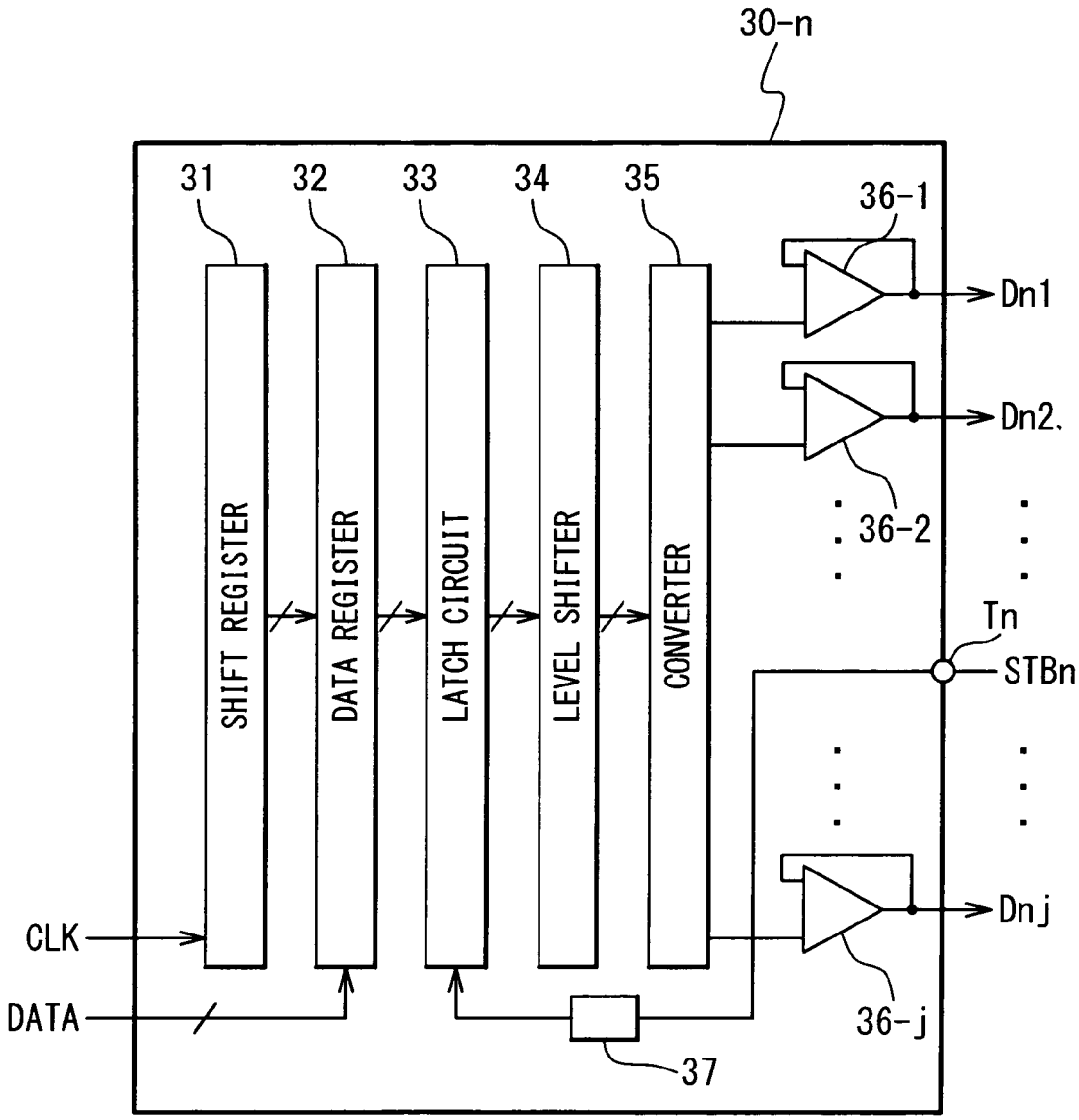
FIG. 4 shows a configuration of one of the n-number of data drivers 30-1 to 30-*n* (exemplified by the data driver 30-*n*) of the TFT liquid crystal display device 1 of the present invention (first and second embodiments)

FIG. 4 shows a configuration of one of the n-number of data drivers 30-1 to **30-*n* (exemplified by the data driver 30-*n***).

Each of the n-number of data drivers 30-1 to **30-*n* includes a shift register 31, a data register 32, a latch circuit 33, a level shifter 34, a digital/analog (D/A) converter 35, and a data output circuit. The data output circuit includes a j-number of output buffers 36-1 to 36-*j***.

The shift register 31 is connected to the data register 32, which is connected to the latch circuit 33. The latch circuit 33 is connected to the level shifter 34, which is connected to the D/A converter 35. The D/A converter 35 is connected to the data output circuit. The j-number of output buffers 36-1 to **36-*j* of the data output circuit of the data driver 30-1 are connected to one ends of the data lines D11 to D1*j*, and a j-number of output buffers 36-1 to 36-*j* of the data output circuit of the data driver 30-*n* are connected to one ends of the data lines Dn1** to Dnj.

For example, the timing controller 2 supplies a clock signal CLK and data shift pulse signals (not shown) and an n-th display data DATA to, for example, the data driver 30-*n* of the n-number of data drivers 30-1 to 30-*n*, and the data driver 30-*n*, in response to the clock signal CLK and the data shift pulse signals, outputs a j-number of one-line display data included in the n-th display data DATA to the data lines Dn1 to Dnj, respectively.

In this case, the shift register 31 of the data driver 30-*n* sequentially shifts the data shift pulse signals in synchronization with the clock signal CLK, and outputs them to the data register 32. The data register 32 of the data driver 30-*n* takes in the j-number of one-line display data from the timing controller 2 in synchronization with the data shift pulse signals and outputs them to the latch circuit 33. The latch circuit 33 of the data driver 30-*n* latches the j-number of one-line display data from the data register 32 at the same timing, and in accordance with the timing determination signal supplied to the terminal Tn, outputs the aforementioned j-number of one-line display data to the level shifter 34. Here, as shown in FIG. 4, between the terminal Tn and the latch circuit 33, a level shifter 37 may be provided as appropriate which has a same function as that of the level shifter 34. The level shifter 34 of the data driver 30-*n* performs level conversion on the j-number of one-line display data, and outputs them to the D/A converter 35. The D/A converter 35 of the data driver 30-*n* performs digital/analog conversion on the j-number of one-line display data from the level shifter 34, and outputs them to the j-number of output buffers 36-1 to 36-*j*, respectively. The j-number of output buffers 36-1 to 36-*j* of the data driver 30-*n* output the j-number of one-line display data from the D/A converter 35 to the data lines Dn1 to Dnj, respectively.

Next, an operation of the TFT liquid crystal display device 1 of the present embodiment will be described.

Here, as described above, the timing controller 2 supplies a selected gate clock signal GCLK for selecting the gate line G11 to the m-number of gate drivers 20-1 to 20-*m* in one horizontal period.

In this case, the gate driver 20-1, in accordance with the selected gate clock signal GCLK, outputs selection signals to the dummy gate line G10 and the gate line G11. At this point, the selection signals are transmitted to the dummy gate line G10 and the gate line G11.

Figure 5A:
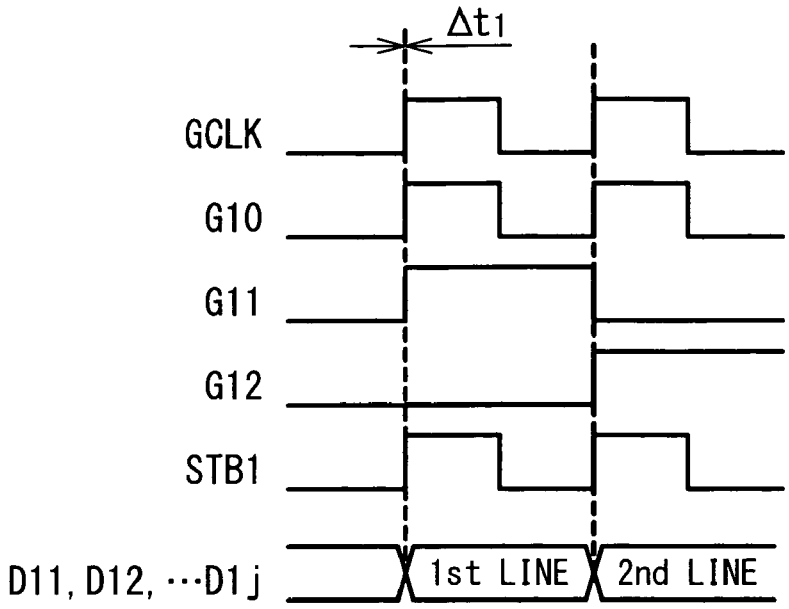
FIG. 5A is a timing chart representing signals supplied to a dummy gate line G10, gate lines G11 to G1*k*, and a timing determination signal line STB1 near a node N1 of the TFT liquid crystal display device 1 of the present invention (first and second embodiments)

As shown in FIG. 5A, when the gate driver 20-1 has outputted the selection signal to the gate line G11, this selection signal is delayed by the resistance and capacitance of the gate line G11. In this case, when the gate driver 20-1 has outputted the selection signal to the dummy gate line G10, this selection signal is delayed by the resistance and capacitance of the dummy gate line G10 by the delay time Δt1. By this delay time Δt1 (transmission timing), selection signals are transmitted to a j-number of positions corresponding to the j-number of data lines D11 to D1*j* of the dummy gate line G10. The selection signal transmitted from the dummy gate line G10 to the timing determination signal line STB1 via the node N1 is transmitted as a first timing determination signal to the terminal T1 of the data driver 30-1 while being delayed by the delay time Δt1. The data driver 30-1, in accordance with the first clock signal CLK and the first timing determination signal, outputs the first display data DATA for one line (j-number of one-line display data) to the data lines D11 to D1*j*.

Figure 5B:
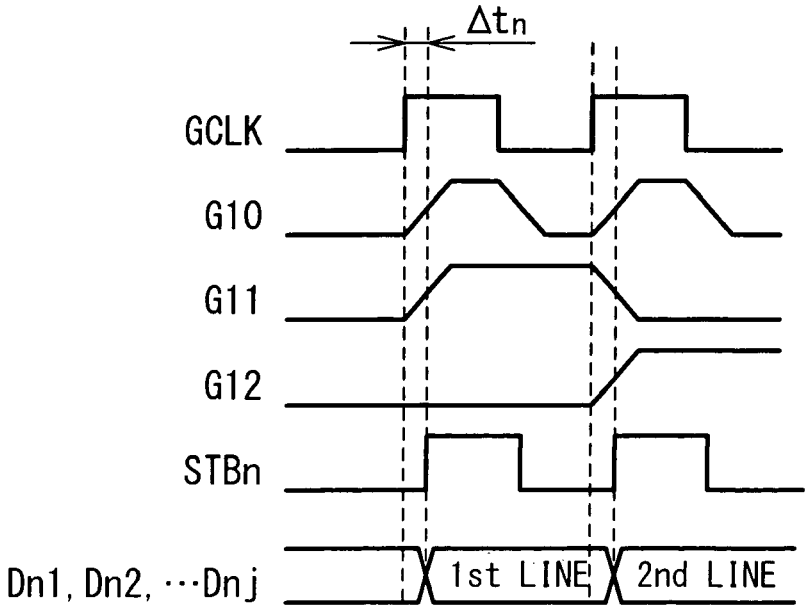
FIG. 5B is a timing chart representing signals supplied to the dummy gate line G10, the gate lines G11 to G1*k*, and a timing determination signal line STBn near a node Nn of the TFT liquid crystal display device 1 of the present invention (first and second embodiments)

Moreover, as shown in FIG. 5B, when the gate driver 20-1 has outputted the selection signal to the dummy gate line G10, this selection signal is delayed by the resistor and capacitor of the dummy gate line G10 by the delay time Δtn. By this delay time Δtn (transmission timing), selection signals are transmitted to a j-number of positions corresponding to the j-number of data lines Dn1 to Dnj of the dummy gate line G10. The delay time Δtn is longer than the delay time Δt1. The selection signal transmitted from the dummy gate line G10 to the timing determination signal line STBn via the node Nn is transmitted as the n-th timing determination signal to the terminal Tn of the data driver 30-*n* while being delayed by the delay time Δtn. The data driver 30-*n*, in accordance with the n-th clock signal CLK and the n-th timing determination signal, outputs the n-th display data DATA for one line (j-number of one-line display data) to the data lines Dn11 to Dnj.

As described above, in the TFT liquid crystal display device 1 of the present embodiment, by previously providing in the dummy gate line G10 the nodes N1 to Nn (timing determination signal lines STB1 to STBn) as desired positions for adjusting transmission timing and outputting timing described above, outputting timing can be adjusted to the delay by the resistor and capacitor of the gate line G11. As a result, in the TFT liquid crystal display device 1 of the present embodiment, displaying defects can be prevented.

Moreover, in the TFT liquid crystal display device 1 of the present embodiment, transmission timing described above is not determined at the terminal end of the dummy gate line G10, and thus optimum positions can be selected flexibly for adjusting the transmission timing and the output timing described above. Thus, displaying defects can be prevented even when the size of the liquid crystal panel 10 becomes very large.

Moreover, with the TFT liquid crystal display device 1 of the present embodiment, an optimum transmission timing and output timing can be selected automatically, which permits further upsizing of the current liquid crystal panel 10.

In the TFT liquid crystal display device 1 of the present embodiment, part or all thereof can be formed with SOG (system on glass).

Figure 6:
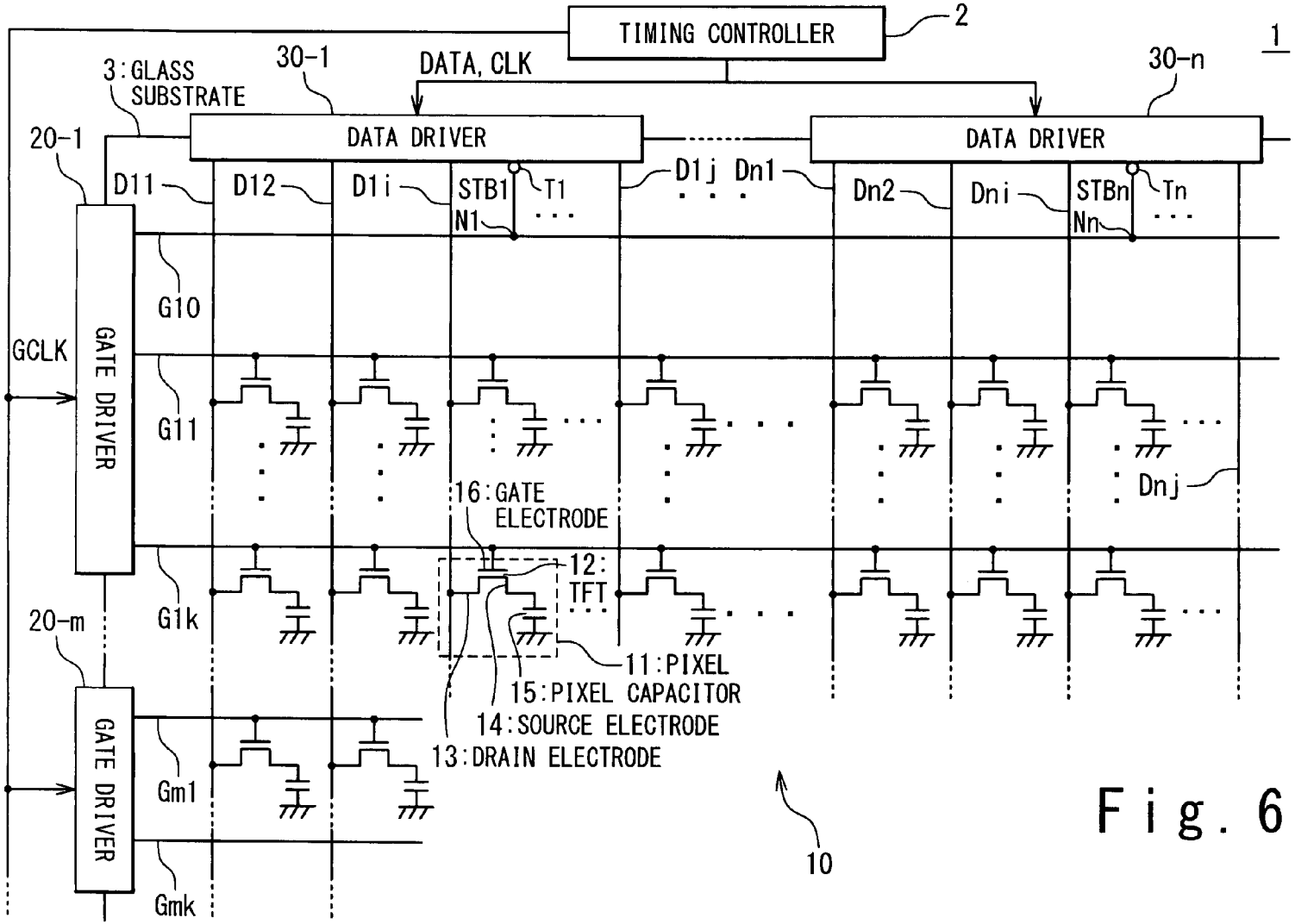
FIG. 6 shows a configuration of the TFT liquid crystal display device 1 as the display device of the present invention (second embodiment).

Moreover, when the TFT liquid crystal display device 1 of the present embodiment is provided as the TFT liquid crystal display device 1 according to the first embodiment, as the TFT liquid crystal display device 1 according to a second embodiment, the dummy pixel 17 may be omitted from the liquid crystal panel 10 as shown in FIG. 6. In this case, an area of the TFT liquid crystal display device 1 according to the second embodiment can be made smaller than an area of the TFT liquid crystal display device 1 according to the first embodiment.

Although the present invention has been described above in connection with several embodiments thereof, it would be apparent to those skilled in the art that those exemplary embodiments are provided solely for illustrating the present invention, and should not be relied upon to construe the appended claims in a limiting sense.

What is claimed is:

1. A display device comprising:

a display unit including a plurality of pixels arranged to form a matrix;

a plurality of scanning lines respectively connected to a plurality of rows of the matrix of the plurality of pixels;

a plurality of data lines respectively connected to a plurality of columns of the matrix of the plurality of pixels;

a dummy scanning line configured to be extended in parallel with the plurality of scanning lines;

a scanning driver configured to output a selection signal to a selected scanning line of the plurality of scanning lines and the dummy scanning line in response to a selection clock signal;

a data driver configured to output a display data for displaying data on one scanning line in response to a timing determination signal; and a timing determination signal line connected to a node preset on the dummy scanning line and configured to transmit the selection signal transmitted to the node to the data driver as the timing determination signal.

2. The display device according to claim 1, wherein the node is preset to a position selected from a plurality of positions on the dummy line and corresponding to the plurality of data lines for adjusting a timing when the selection signal is transmitted to the plurality of positions and a timing of an output of the data driver.

3. The display device according to claim 2, wherein k number of scanning lines from first to k-th (k is an integer more than one) as the plurality of scanning lines and the dummy scanning line are connected to the scanning driver, j number of data lines from first to j-th (j is an integer more than one) as the plurality of data lines and the timing determination signal line are connected to the data driver, the node is preset on a position corresponding to i-th data line of the plurality of data lines (i is an integer satisfying $1 \leqq i \leqq j$), the scanning driver outputs the selection signal to the dummy scanning signal and the selected scanning line of the k number of scanning lines in response to the selection clock signal, the selection signal transmitted from the dummy scanning line to the timing determination signal line through the node is transmitted to the data driver as the timing determination signal, and the data driver outputs the display data for displaying data on one scanning line to the j number of data lines in response to the timing determination signal.

4. The display device according to claim 3, further comprising:

m−1 number of other scanning drivers (m is an integer more than 1);

n−1 number of other data drivers (n is an integer more than 1); and n−1 number of other timing determination signal lines, wherein k number of scanning lines are connected to each of the m−1 number of other scanning drivers, j number of data lines are connected to each of the n−1 number of other data drivers, n−1 number of nodes are further preset on the dummy scanning line, the n−1 number of other timing determination signal lines are respectively connected to the n−1 number of nodes, the n−1 number of other data drivers are respectively connected to the n−1 number of the other timing determination signal lines, in response to the selection clock signal, the scanning driver outputs other selection signal to the dummy scanning line, and a selected scanning driver of the m−1 number of other scanning drivers outputs the other selection signal to a selected scanning line of the k number of scanning lines connected to the selected scanning driver, the other selection signal transmitted to n number of timing determination signal lines consisting of the timing determination signal line and the n−1 number of other timing determination signal lines via n number of nodes consisting of the node and the n−1 number of nodes are respectively transmitted to n number of data drivers consisting of the data driver and the n−1 number of other drivers as n number of timing determination signals, and the n number of data drivers respectively output a display data to j number of data lines connected to each of the n number of data drivers in response to the n number of timing determination signals to output data for displaying one scanning line.

5. The display device according to claim 1, further comprising:

a timing controller configured to supply the selection clock signal to the scanning driver, and supply the display data to the data driver.

6. The display device according to claim 1, wherein the display unit is a liquid crystal panel, each of the plurality of pixels includes a TFT (Thin Film Transistor), and each of the plurality of scanning lines is a gate line connected to a gate of the TFT included in the plurality of pixels.

* * * * *